US008408549B2

(12) United States Patent
Howard et al.

(10) Patent No.: US 8,408,549 B2
(45) Date of Patent: Apr. 2, 2013

(54) GAMING DICE

(75) Inventors: Cephas Edgar Howard, Billund (DK); Ditte Bruun Pedersen, Billund (DK)

(73) Assignee: Lego A/S, Billund (DK)

( * ) Notice: Subject to any disclaimer, the term of this patent is extended or adjusted under 35 U.S.C. 154(b) by 145 days.

(21) Appl. No.: 12/866,086

(22) PCT Filed: Feb. 5, 2009

(86) PCT No.: PCT/DK2009/000030

§ 371 (c)(1),
(2), (4) Date: Oct. 21, 2010

(87) PCT Pub. No.: WO2009/097852

PCT Pub. Date: Aug. 13, 2009

(65) Prior Publication Data

US 2011/0042891 A1 Feb. 24, 2011

(30) Foreign Application Priority Data

Feb. 5, 2008 (DK) ..... 2008 00154

(51) Int. Cl.
*A63F 9/04* (2006.01)

(52) U.S. Cl. ..... 273/146

(58) Field of Classification Search ..... 273/146; 434/171

See application file for complete search history.

(56) References Cited

U.S. PATENT DOCUMENTS

| | | | | |
|---|---|---|---|---|
| 1,100,549 | A | 6/1914 | Elkins | |
| 1,531,542 | A * | 3/1925 | Cogshall | 434/172 |
| 1,971,545 | A * | 8/1934 | Tompkins | 446/121 |
| 2,079,850 | A * | 5/1937 | Gessler | 273/148 R |
| 2,249,060 | A * | 7/1941 | Stone | 446/124 |
| 3,110,123 | A * | 11/1963 | Pearson, Jr. | 446/110 |
| 3,195,266 | A * | 7/1965 | Onanian | 446/86 |
| 3,374,917 | A * | 3/1968 | Troy | 220/23.4 |
| 3,492,756 | A * | 2/1970 | Stubbmann | 446/85 |
| 3,566,531 | A * | 3/1971 | Hasel et al. | 446/120 |
| 3,608,906 | A * | 9/1971 | Odier | 273/157 R |
| 3,612,537 | A * | 10/1971 | Sato | 273/156 |
| 3,626,632 | A * | 12/1971 | Bullock, Jr. | 446/125 |
| 3,929,337 | A * | 12/1975 | Hayes | 273/243 |

(Continued)

FOREIGN PATENT DOCUMENTS

| | | |
|---|---|---|
| CH | 450254 | 1/1968 |
| CH | 686288 | 2/1996 |

(Continued)

OTHER PUBLICATIONS

Notice of Reason for Rejection for JP Patent Application No. 2010-545356 dated Aug. 1, 2012; 1 page.

(Continued)

*Primary Examiner* — Kurt Fernstrom
*Assistant Examiner* — Dolores Collins
(74) *Attorney, Agent, or Firm* — Day Pitney LLP

(57) ABSTRACT

A gaming dice for a game, such as a board game or a card game, said gaming dice comprising a body part comprising a number of sides, wherein at least one or more of those sides is/are provided with coupling studs. Hereby it is possible to mount indicia-carrying elements that have a bottom side on which complementary coupling means are provided and a top side which is opposite relative to the bottom side and is provided with indicia.

16 Claims, 2 Drawing Sheets

U.S. PATENT DOCUMENTS

| | | | | | |
|---|---|---|---|---|---|
| 4,003,144 | A | | 1/1977 | Maddestra et al. | |
| D255,039 | S | * | 5/1980 | Gale | D21/500 |
| 4,669,728 | A | * | 6/1987 | Carden | 463/22 |
| 4,699,601 | A | * | 10/1987 | Hershfeld | 446/69 |
| 4,808,140 | A | * | 2/1989 | Clavet | 446/127 |
| 4,890,152 | A | * | 12/1989 | Hirata et al. | 257/666 |
| 4,897,066 | A | * | 1/1990 | Tapdrup et al. | 446/97 |
| 5,125,867 | A | * | 6/1992 | Solomon | 446/488 |
| 5,306,198 | A | | 4/1994 | Forman | |
| 5,447,433 | A | * | 9/1995 | Perry, Jr. | 434/171 |
| D370,503 | S | * | 6/1996 | Burns | D21/500 |
| 5,575,161 | A | * | 11/1996 | Hinchey | 63/33 |
| 5,674,103 | A | * | 10/1997 | Bean | 446/75 |
| 6,050,044 | A | * | 4/2000 | McIntosh | 52/591.1 |
| 6,102,766 | A | * | 8/2000 | Leadbetter et al. | 446/128 |
| 6,158,738 | A | * | 12/2000 | Van Buskirk | 273/147 |
| 6,241,248 | B1 | * | 6/2001 | Winter | 273/153 S |
| D445,148 | S | * | 7/2001 | McIntosh | D21/500 |
| 6,511,073 | B2 | * | 1/2003 | Simonds | 273/299 |
| 6,679,780 | B1 | * | 1/2004 | Shih | 273/157 R |
| D489,418 | S | * | 5/2004 | Helton, Sr. | D21/373 |
| 6,828,002 | B2 | * | 12/2004 | Chou et al. | 428/81 |
| 7,780,166 | B1 | * | 8/2010 | Paxton et al. | 273/145 C |
| 2003/0218299 | A1 | * | 11/2003 | Zapata | 273/146 |
| 2007/0200291 | A1 | | 8/2007 | McEowen | |
| 2011/0101607 | A1 | * | 5/2011 | Howard et al. | 273/146 |

FOREIGN PATENT DOCUMENTS

| | | |
|---|---|---|
| DE | 2255936 | 5/1974 |
| DE | 202005001584 | 5/2005 |
| DE | 202005006329 | 7/2005 |
| WO | 93/17767 | 9/1993 |
| WO | 95/13849 | 5/1995 |

OTHER PUBLICATIONS

Web pages of "Lego Device", Original Works made from Lego Blocks dated Feb. 16, 1999; Accessed at URL: http://hwm3.gyao.ne.jp/clublego/origin/o_dice/dice.html; 18 pages.

* cited by examiner

GAMING DICE

FIELD OF USE OF THE INVENTION

The present invention relates to a gaming dice for a game and a game, wherein the gaming dice comprises a number of sides, and wherein at least one or more of such sides is/are provided with means for mounting of an indicia-carrying element; and wherein the means for mounting of an indicia-carrying element comprises one or more coupling studs that extend at a given height from at least one side of the dice.

STATE OF THE ART

Gaming dice are used in the context of games of many different types, such as board games, card games and so on. For such games, cubic game dice with six sides of equal size and being essentially square are generally used, but gaming dice are known that have both more and fewer sides than six depending on the number of outcomes desired by use of the gaming dice.

The most known embodiment of a six-sided gaming dice is configured such that each of the sides of the dice is provided with a number of dots or pips to the effect that a throw of dice may result in equal probabilities for the side facing upwards showing a number of pips from one to six.

Over the years, games have been developed that have entailed the need for gaming dice that may provide other outcomes than the above one through six pips, and thus gaming dice have been developed wherein some or all sides of the gaming dice is/are provided with other indicia than the known pips.

Besides, CH patent No. 450254 and 686288 and DE utility model No. 202005001584, U.S. Pat. No. 1,100,549 and PCT application No. 95/13849 teach gaming dice of the kind set forth in the introductory part, wherein the dice sides are configured with means for mounting indicia-carrying elements that can thereby be varied with a view to configuring a gaming dice with precisely the desired outcomes that match a given game. These latter gaming dice thus enable the option of exchanging and adapting the indicia-carrying elements on the gaming dice to the effect that it is possible, by means of one single dice, to create far more possible outcomes when the dice is thrown. On the whole, the development of gaming dice has focused precisely on providing new options for games by enabling more different outcomes when the gaming dice is thrown.

However, it is a problem in the context of configuring that type of dice that the configuration of the dice may, on the one hand, be such that the mounting as such of indicia-carrying elements can, to a certain extent, change the probability of the dice coming to sit on a given side upon being thrown, and, on the other hand, that it is to be ensured that both the dice and the indicia-carrying elements are sufficiently robust for withstanding being assembled and disassembled innumerable times.

Object of the Invention

Based on this, it is the object of the present invention to provide a gaming dice and a game that enable further options for new kinds of games or more options for different outcomes when the gaming dice is thrown; and wherein the elements of the dice are extremely durable, while simultaneously the probability distribution of the dice is altered minimally upon mounting of the indicia-carrying elements to the dice.

This is accomplished in accordance with the invention in that at least a portion of the edges of the gaming dice is provided with flanges that extend from the sides of the dice at a distance that corresponds to or is bigger than the height of the coupling studs measured at right angles to the sides of the dice. As it is, hereby it is accomplished on the one hand that the gaming dice is well suited for mounting of indicia-carrying elements that have a coupling means which is configured to be complementary to the coupling studs, while simultaneously it influences the properties of the gaming dice minimally.

It is possible to configure the couplings studs in concordance with the couplings studs of a known toy building set, but according to the invention the gaming dice may advantageously further comprise at least one indicia-carrying element, which indicia-carrying element has a bottom side having a coupling means which is complementarily configured relative to one of the coupling studs to the effect that they allow mounting of the indicia-carrying elements onto the dice by the complementary coupling parts being interconnected frictionally or by geometrical locking to the coupling studs on the sides of the dice.

According to an expedient embodiment, each of the indicia-carrying elements has a top face which is arranged opposite and at a given distance from the bottom side featuring the complementary coupling parts, and wherein the top side is provided with different indicia, such as different shapes, ornamentations, colours or graphic prints.

To further ensure that the probability properties of the gaming dice corresponds to those of an ordinary gaming dice, any of the edges of the gaming dice may advantageously be provided with flanges that extend from the sides of the dice at a distance that corresponds to or exceeds the height of the coupling studs measured at right angles to the sides of the dice.

In this context the edges of the gaming dice would further advantageously be provided with flanges that extend from the sides of the dice at a distance that corresponds to or exceeds the distance from the sides of the gaming dice and to the surface of at least one indicia-carrying element mounted to one of the sides of the gaming dice, measured at right angles to the sides of the dice. Hereby it is accomplished that the influence of the indicia-carrying elements on the probability properties of the gaming dice is further minimised.

Advantageously the gaming dice is configured from two different plastics materials to the effect that the flanges are configured from a material which is more elastic than the material constituting the coupling studs on the sides of the gaming dice.

In this context, the two plastics materials may advantageously have colours that differ from each other.

The indicia-carrying elements and the flanges on the gaming dice may be configured such that there is a distance there between when the indicia-carrying element is mounted on the gaming dice, which distance is so great that a user of the dice is able to release the indicia-carrying element from the gaming dice by introducing a flat object, such as a nail, between the indicia-carrying element and an adjacent flange on the gaming dice. Hereby it is made easy for the user to exchange the indicia-carrying elements on the gaming dice.

The accessibility for exchange of the indicia-carrying elements is further enhanced if the flanges have two opposing side faces that each extends at an angle relative to the side faces that are adjacent relative to the flange, and which angle exceeds 90° and preferably exceeds 120°.

The rolling properties of the gaming dice are further enhanced if each flange has a surface which is convex relative to the body part of the gaming dice.

LIST OF FIGURES

EMBODIMENT OF THE INVENTION

Figure 1:
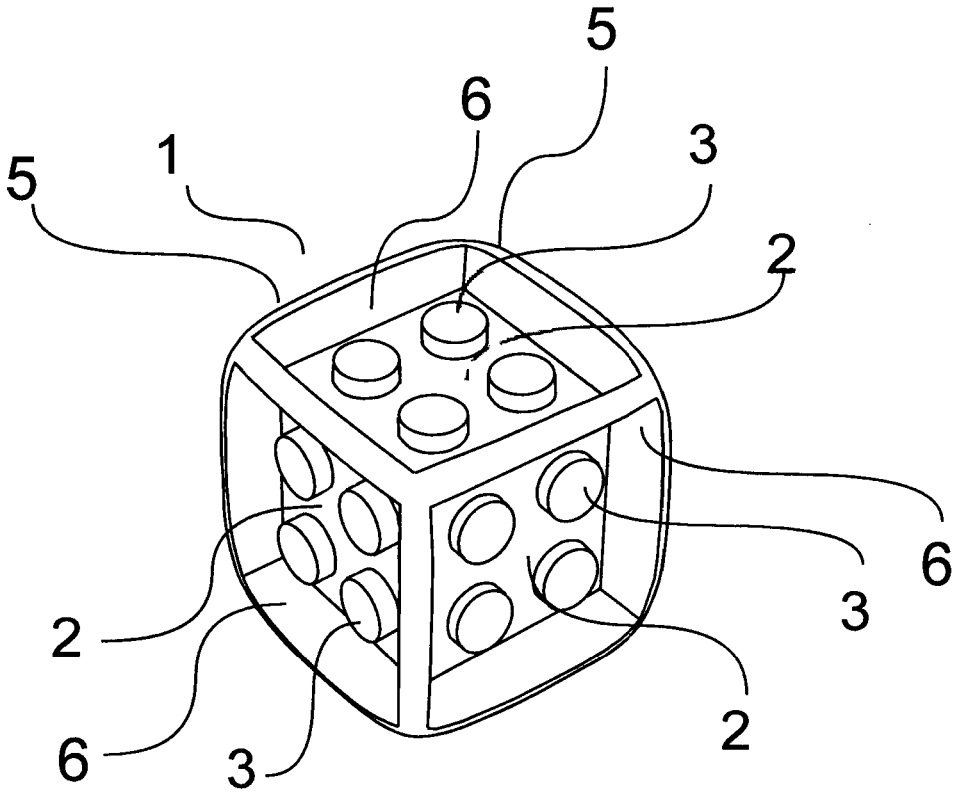
FIG. 1 is a perspective view of a gaming dice according to the present invention, seen in an inclined view from above.

Thus, FIG. 1 shows a gaming dice 1 according to the present invention, wherein the gaming dice 1 is of the most common type, wherein the gaming dice 1 has six identical sides 2, and wherein each of these sides 2 is configured to be essentially square to the effect that the probability of the gaming dice 2 coming to rest on a given side following throw of the gaming dice 1 is equally high for all the sides 2 of the gaming dice 1.

As shown in FIG. 1, the sides 2 of the gaming dice 1 are essentially identical and thus a throw of such gaming dice 1 will not in itself be meaningful, it not being possible for the user to distinguish between the outcomes of such throw of the dice. According to this preferred embodiment of the invention, four couplings studs 3 are therefore provided on each of the sides 2 and are arranged in a square pattern to the effect that the coupling studs 3 form corners in a square, and the coupling studs 3 are configured such that it is possible to mount building elements from a toy building system known per se on the coupling studs 3 to the effect that the sides 2 of the gaming dice are able to change nature upon mounting of different such building elements on the sides 2 of the gaming dice 1.

By mounting different building elements on the gaming dice 1 according to FIG. 1, it is thus possible to impart to each side 2 of the gaming dice its own nature if the elements that are mounted on the gaming dice 1 vary in number, shape or appearance as such. The coupling studs 3 projecting from the sides 2 of the gaming dice 1, a coupling system is hereby accomplished on which it is possible to mount robust, indicia-carrying elements 4*a*, 4*b*, 4*c*, such as building plates of an already known toy building system, that are retained by friction onto the coupling studs 3, and thereby they cannot unintentionally fall off by themselves, while yet permitting easy disassembly. At the same time it is thereby accomplished that a major part of the weight of the coupling system is located as an integral part of the gaming dice 1 as such, whereby, all other things being equal, a gaming dice is accomplished whose probability properties are influenced comparatively little when indicia-carrying elements 4*a*, 4*b*, 4*c* are mounted on the sides 2 of the gaming dice 1.

It will further appear from FIG. 1 that the gaming dice 1 according to the invention is provided with flanges 5 at those edges of the gaming dice 1 that separate the individual sides or side faces 2. The flanges 5 thus project from the edges of the gaming dice 1 at a distance measured from the sides 2 of the gaming dice 1 and thus form a frame around each side 2 which thereby increases the base area of the gaming dice 1 whereby it can rest on at least a part of the surface of the flanges 5. In this way it is further ensured that the probability properties of the gaming dice 1 are not significantly altered when indicia-carrying elements 4*a*, 4*b*, 4*c* are mounted on the sides 2 of the gaming dice.

Here, the flanges 5 are configured such that the surface of each of the flanges 1 has a curved shape which is convex longitudinally of the edges of the gaming dice 1, seen from the interior of the gaming dice 1, to the effect that each flange 5 is higher at the middle than at the corners of the gaming dice 1, whereby the rolling properties of the gaming dice are further enhanced.

Figure 2:
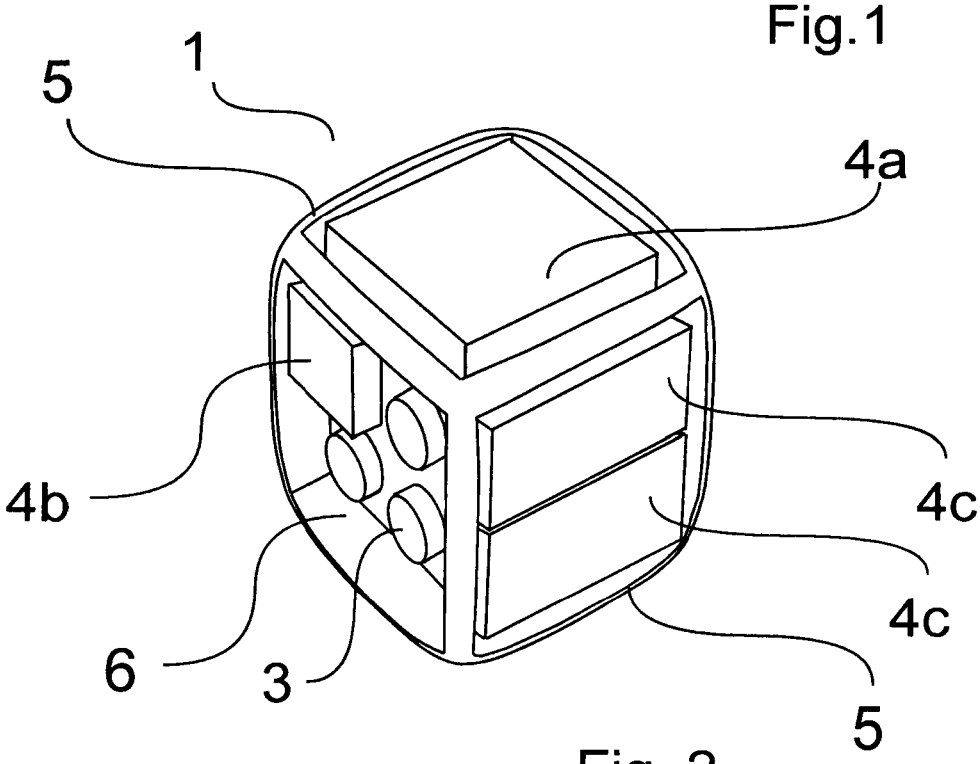
FIG. 2 is a perspective view of the gaming dice according to the invention shown in FIG. 1, seen in an inclined view from above, and wherein a number of indicia-carrying elements are mounted thereto.

Now, FIG. 2 shows the same gaming dice 1 as is shown in FIGS. 1 and 5, and wherein, on at least the three visible sides 2 of the gaming dice, building plates 4, 4*b*, 4*c* from a toy building system known per se are mounted. On the one side that faces upwards, a square building plate 4*a* is thus mounted that covers all four coupling studs on the side 2 to the effect that the building plate does not leave space for mounting of further building elements on that side 2. On the two other visible sides 2 of the gaming dice 1, a single square building plate 4*b* is mounted that covers precisely one single one of the coupling studs 3 on the one side 2, and, on the other side 2, two rectangular building plates 4*c* are mounted that each covers precisely two coupling studs 3 on that side 2, respectively, to the effect that the two rectangular building plates 4*c* do not leave space for further mounting of building plates on that side 2.

The indicia-carrying elements in the form of building plates 4*a*, 4*b*, 4*c* are configured such that they have a bottom side on which one or more complementary coupling means are provided that can be interconnected by friction on the coupling studs 3 on the sides 2 of the gaming dice 1. Obviously, the person skilled in the art is able to configure the complementary coupling means in many ways without departing from the principle underlying the present invention, and therefore they are not shown in the figures. The indicia-carrying elements 4*a*, 4*b*, 4*c* are configured such that, upon mounting to the sides 2 of the gaming dice 1, they are located at a distance from the flanges 5 to the effect that easy dismounting of the indicia-carrying elements is enabled by allowing introduction of eg a nail or other suitable tool between the indicia-carrying element 4*a*, 4*b*, 4*c* and the most proximate flange 5, whereby the indicia-carrying element 4*a*, 4*b*, 4*c* can easily be flipped off by use of the leverage effect. As shown, flanges 5 are configured such that they have side faces 6 that project from the sides 2 of the dice 1 at a blunt angle to the effect that it further provides space for the introduction of a tool between a flange 5 and an indicia-carrying element 4*a*, 4*b*, 4*c*.

In this way it is seen that, upon mounting of building plates, it can be achieved that all the sides of the gaming dice can be configured individually, to the effect that the invention provides a large number of different options for building a gaming dice that is configured specifically for a particular game.

As set forth above, sides 2 on the gaming dice 1 can thereby the varied exclusively by mounting a different number of building plates on the gaming dice or by mounting building plates of different sizes. However, according to the present invention, it is also an option to vary the configuration of the sides 2 by varying the shapes, colours, ornamentations and/or printed motifs of the building elements.

According to the invention, the gaming dice 1 may thus comprise a number of different indicia-carrying elements 4*a*, 4*b*, 4*c* that may very well be configured in the same way as the above-mentioned building elements 4*a*, 4*b*, 4*c*, but are dedicated for use in varying the sides 2 of the gaming dice 1 by them being provided with indicia having different shapes, sizes, ornamentations, colours or motifs on the side that faces outwards when the indicia-carrying element 4*a*, 4*b*, 4*c* is mounted on one of the sides 2 of the gaming dice 1.

Thereby it is possible to accomplish that, by one single gaming dice, a very large number of different options is provided for designing the gaming dice 1 to the game it is desired to play or optionally to change the configuration and nature of the gaming dice 1 as a part of the game. This is accomplished by use of comparatively few individual components.

Obviously, the shown dice is of a preferred embodiment, and it is possible for the person skilled in the art to configure dice having other basic shapes without departing from the fundamental principle of the present invention. Thus, it is possible to provide gaming dice with more or fewer sides and the shapes and sizes of the sides may also be varied.

Figure 3:
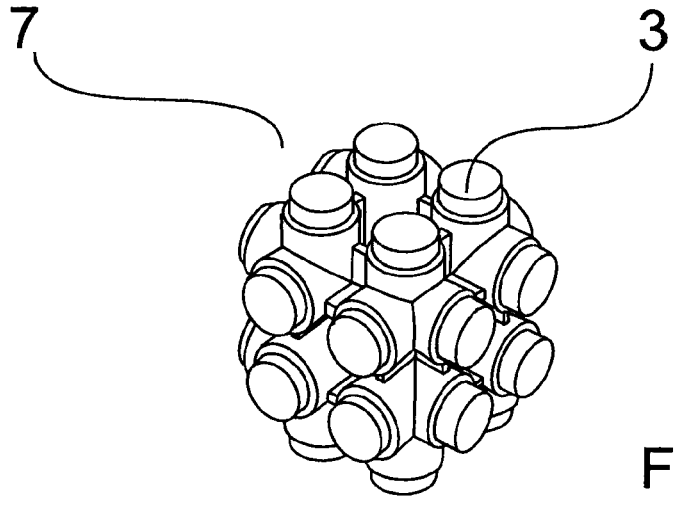
FIG. 3 is a perspective view of a core for a gaming device according to the present invention, seen in an inclined view from above.
Figure 4:
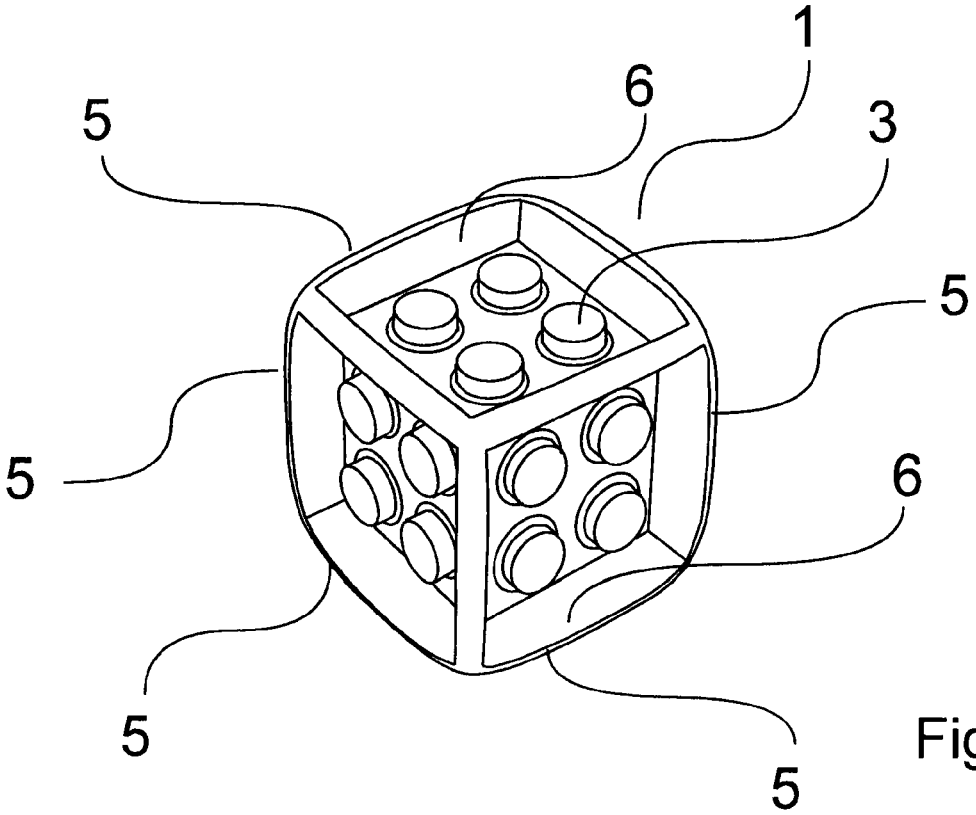
FIG. 4 is a perspective view of the core shown in FIG. 3, but in finished form, seen in an inclined view from above.

Now, FIGS. 3 and 4 show an embodiment of a gaming dice 1 according to the present invention, wherein the gaming dice is configured from two different materials comprising a comparatively hard component constituting at least the coupling studs 3 of the gaming dice 1, and a comparatively soft component comprising at least the flanges 5 of the gaming dice 1. In this context, FIG. 3 shows a core piece 7 that constitutes a core and the coupling studs 3 on the gaming dice 1. The core piece 7 is configured from a comparatively hard plastics material and is configured such that it may be provided in an injection moulding process in a tool suitable therefore (not shown). The core piece may subsequently, upon arrangement in another injection moulding cavity at in a two-component injection moulding process, be provided with the comparatively soft component that constitutes at least the flanges 5 on the gaming dice. Thereby a gaming dice 1 is accomplished which is robust and which is able to efficiently retain the indicia-carrying elements 4*a*, 4*b*, 4*c* on the relatively hard coupling studs 3, but has good rolling properties and does not make much noise when the dice is thrown.

In this context, it is obvious that the two plastics materials may have different colours to the effect that at least the couplings studs 3 or the flanges 5 have a colour that deviates relative to the remainder of the gaming dice.

The invention claimed is:

1. A reconfigurable gaming dice for a game, said gaming dice comprising:

a body part including a number of essentially planar sides that are separated from each other by a plurality of edges, wherein at least one of the sides is provided with at least one coupling stud that projects at a first height from the at least one side of the dice, and wherein at least a portion of the plurality of edges on the gaming dice is provided with a flange that projects outwardly from at least one side of the dice at a second height that is at least as high as the first height of the at least one coupling stud measured at right angles to the sides of the dice to prevent the at least one coupling stud from contacting a flat planar surface on which the dice is resting; and at least one indicia-carrying element, the at least one indicia carrying element configured to be disposed on the at least one coupling stud, the at least one indicia carrying element having a bottom side with a recess that is adapted to receive the at least one coupling stud.

2. A gaming dice according to claim 1, wherein the indicia carrying element and the at least one coupling stud are held together by frictional or geometrical locking.

3. A gaming dice according to claim 1, wherein the at least one indicia-carrying element has a top side opposite the bottom side, the top side including indicia disposed thereon.

4. A gaming dice according to claim 3, wherein at least a portion of an edge of the gaming dice is provided with a flange that projects outwardly from at least one side of the dice at a second height that is at least as high as the top surface of the indicia-carrying element mounted on the at least one coupling stud measured at right angles to the sides of the dice to prevent the indicia from contacting a flat planar surface on which the dice is resting.

5. A gaming dice according to claim 1, wherein each edge of the gaming dice is provided with a flange that projects outwardly from at least one side of the dice at a second height that is at least as high as the first height of the at least one coupling stud measured at right angles to the sides of the dice to prevent the at least one coupling stud from contacting a flat planar surface on which the dice is resting.

6. A gaming dice according to claim 5, wherein every flange has an outwardly facing convex surface that faces away and outwardly from the center of the gaming dice.

7. A gaming dice according to claim 1, wherein the flange is composed at least in part from a first material that is more elastic than a second material from which the at least one coupling stud is formed.

8. A gaming dice according to claim 7, wherein the first material and second material are different colors.

9. A gaming dice according to claim 1, wherein the at least one indicia carrying element and at the flange define a gap therebetween of sufficient width to permit a user of the gaming dice is able to release the at least one indicia-carrying element from the gaming dice by introducing a flat object between the at least one indicia-carrying element and the flange.

10. A gaming dice according to claim 1, wherein the flange has two opposing side faces that each extend at a blunt angle relative to the two side faces that are adjacent relative to the flange at an angle that exceeds 90°.

11. A gaming dice according to claim 10, wherein the angle exceeds 120°.

12. A gaming dice according to claim 1, wherein the at least one coupling stud and is adapted and configured to mate with a building element of a toy building set.

13. A gaming dice according to claim 1, wherein the gaming dice includes a plurality of different indicia mounted to different sides of the gaming dice, the different indicia differing by way of at least one of (i) shape, (ii) ornamentation, (iii) color and (iv) graphic prints.

14. A building set including the gaming dice of claim 1.

15. A game including the gaming dice of claim 1.

16. A gaming dice according to claim 1, wherein the dice has six opposing sides to form a cube, and further wherein each of the twelve edges of the dice includes an outwardly facing flange along its length, each of the flanges joining at the corners of the dice.

* * * * *